US005940986A

United States Patent [19]

Jelinek et al.

[11] Patent Number: 5,940,986

[45] Date of Patent: Aug. 24, 1999

[54] HEAT STAKED MOISTURE SENSOR ELECTRODES

[75] Inventors: Victor E. Jelinek, Webster City; David L. Williams, Roland, both of Iowa

[73] Assignee: White Consolidated Industries, Inc., Cleveland, Ohio

[21] Appl. No.: 08/857,634

[22] Filed: May 16, 1997

[51] Int. Cl.[6] ..... F26B 13/10

[52] U.S. Cl. ..... 34/528; 34/89

[58] Field of Search ..... 34/89, 235, 524, 34/528, 555, 565, 603, 604, 602, 606

[56] References Cited

U.S. PATENT DOCUMENTS

| | | | |
|---|---|---|---|
| 2,779,305 | 1/1957 | Dunkelman | 34/89 |
| 2,809,399 | 10/1957 | Mead et al. | 156/272.4 |
| 3,489,879 | 1/1970 | Salzer | 219/152 |
| 3,916,147 | 10/1975 | Mercer | 219/234 |
| 3,998,824 | 12/1976 | Otsuki et al. | 264/249 |
| 4,136,275 | 1/1979 | McCullough | 219/230 |
| 4,195,219 | 3/1980 | Friese | 219/388 |
| 4,385,452 | 5/1983 | Deschaaf et al. | 34/562 |
| 4,422,247 | 12/1983 | Deschaff | 34/550 |
| 4,477,982 | 10/1984 | Cotton | 34/550 |
| 4,540,533 | 9/1985 | Sahakian | 264/1.38 |
| 4,761,871 | 8/1988 | O'Connor et al. | 29/432.1 |
| 4,780,259 | 10/1988 | Buttry et al. | 264/249 |
| 4,825,527 | 5/1989 | Ladouceur | 29/432 |
| 4,899,464 | 2/1990 | Carr et al. | 34/604 |
| 5,018,957 | 5/1991 | Assink et al. | 227/178.1 |
| 5,152,053 | 10/1992 | Vossen et al. | 29/798 |
| 5,266,258 | 11/1993 | Martin | 264/249 |
| 5,361,478 | 11/1994 | Grossberndt et al. | 29/432.2 |
| 5,372,665 | 12/1994 | Chafin et al. | 156/73.1 |
| 5,397,522 | 3/1995 | Shinozuka et al. | 264/134 |
| 5,467,077 | 11/1995 | Wunderlich et al. | 340/635 |
| 5,625,962 | 5/1997 | Fleissner | 34/446 |

*Primary Examiner*—Henry Bennett
*Assistant Examiner*—Pamela A. Wilson
*Attorney, Agent, or Firm*—Pearne, Gordon, McCoy & Granger LLP

[57] ABSTRACT

An exhaust vent cover assembly and method of manufacture. The vent cover assembly includes a vent cover and a pair of heat stacked moisture sensor electrodes. The vent cover includes a perforated first portion defining a first plane and a solid second portion defining a second plane. The second plane is at an angle to the first plane. The vent cover is formed from a non-conductive material, and the electrodes are embedded in the second portion of the cover. The electrodes include a plurality of retainers to prevent removal from the cover assembly.

15 Claims, 5 Drawing Sheets

34
28
26
38
42
40
46
48
44
54
52
12
24
50
30

HEAT STAKED MOISTURE SENSOR ELECTRODES

BACKGROUND OF THE INVENTION

1. Field of the Invention

The present invention generally pertains to clothes dryers and, more particularly, to clothes dryer moisture sensors.

2. Description of Related Art

As clothes dryers have evolved, it has become common to provide controls to automatically terminate a drying operation. Initially, these controls consisted of user-set mechanical timers. However, mechanical timers are only operable to switch between modes of operation after a predetermined period of time, and may tend to over-dry or under-dry clothes.

An improved system monitors the humidity of the air stream in the exhaust duct and correlates the clothes wetness or moisture content to the sensed humidity. When the sensed humidity corresponds to a user-selected dryness condition, the drying operation is discontinued. Systems utilizing exhaust duct humidity sensors have been on the market for a number of years.

Similarly, it has become common to provide sensors within the clothes receiving compartment which are contacted by the tumbling clothes during a drying operation. Generally, a pair of elongated or bar-shaped sensor electrodes are provided within the dryer and face toward the interior of the dryer drum such that clothes being tumbled and dried will periodically engage and bridge the electrodes. The sensed resistance between the electrodes is used to determine the dryness of the clothes.

A high resistance between the electrodes is indicative of either an open circuit (no clothes bridging with the electrodes) or that the clothes are dry. A low resistance between the electrodes is indicative of wet clothes bridging the electrodes. A short circuit is indicative of a conductive element (button, zipper, etc) bridging the electrodes. Appropriate control circuitry, including time delays, make it possible to determine when the clothes have reached a desired dryness condition. As such, the elongated electrodes may be an essential part of an automatic control system for a clothes dryer. However, the placement and long-term viability of moisture sensors within the dryer drum has been problematic.

One attempt to provide dryness electrodes within a clothes dryer is illustrated by U.S. Pat. No. 4,899,464 to Carr et al. The '464 patent discloses a pair of sensor strips secured to a dryer outlet grill. The outlet grill is secured to a front wall of the dryer cabinet, faces toward the interior of the drum, and covers an exhaust duct that receives exhaust air from the drum. The grill defines a plane which is at an angle to the plane of the front wall. The sensor strips are provided at a lower end of the grill, and are provided near an outer periphery of the drum.

The sensor strips of the '464 patent are mechanically attached to the grill by making use of projections from the strips and cooperating recesses and walls provided by the grill. Unfortunately, since the grill and strips are formed from different materials having different coefficients of thermal expansion, and since the interior of the clothes dryer is subject to repeated heating and cooling, the sensor strips may tend to loosen over time. Moreover, lint tends to accumulate beneath the sensor strips and may tend to push the sensor strips away from the grill. As such, buttons, loops, or other projections from clothing may become snagged on the sensor strips, damaging the strips or the clothes.

Therefore, there exists a need in the art for an improved grill assembly wherein the moisture sensors are permanently affixed to the grill and will not move relative to the grill. There also exists a need in the art for a grill assembly wherein the sensors will not trap lint or become entangled with clothing within the drum. Finally, there exists a need in the art for a grill assembly wherein the air flow passage provided by the grill is maximized, and the provision of sensor electrodes on the grill assembly does not significantly reduce the size, number, or location of the grill openings.

SUMMARY OF THE INVENTION

The present invention is directed toward an improved grill assembly for a clothes dryer wherein moisture sensors are permanently affixed to the grill such that the sensors cannot move relative to the grill. The present invention is further directed toward a grill assembly wherein the sensors are permanently attached to the grill and positioned such that lint will not accumulate between the sensors and the grill. The present invention is also directed to a grill assembly wherein an air flow exhaust passage is maximized, and the inclusion of moisture sensor electrodes on the grill does not significantly affect the size, number or location of the grill openings.

In accordance with the present invention, an exhaust grill has a first portion and a second portion. The first portion defines a first plane and has a series of openings through which exhaust air may pass. The second portion defines a second plane and has a pair of elongated moisture sensors embedded therein. The first plane is at an angle to the second plane, and the sensors are remote from the first portion.

In further accordance with the present invention, the grill is formed from a unitary piece of non-conductive material, and the sensors are formed from a conductive material. The second portion has a forwardly-directed surface and a rearwardly-directed surface. The sensors project from the forwardly-directed surface and are embedded within the rearwardly-directed surface. The projecting portion of the sensors define terminals or contacts. The second portion further comprises a projecting tab to restrict access to the sensor terminals.

In further accordance with the present invention, a clothes dryer includes a clothes-receiving drum, a cabinet, and an exhaust vent assembly. The exhaust vent assembly cooperates with the cabinet to define a lint filter receptacle. The exhaust vent assembly includes a grill having first and second portions. The first portion defines a first plane, and the second portion defines a second plane, which is angled relative to the first plane. The second portion has a pair of elongated moisture sensors secured thereto. The sensors are disposed adjacent the drum and remote from the first portion.

BRIEF DESCRIPTION OF THE DRAWINGS

These and further features of the invention will be apparent with reference to the following description and drawings, wherein.

DETAILED DESCRIPTION OF THE PREFERRED EMBODIMENT

Figure 1:
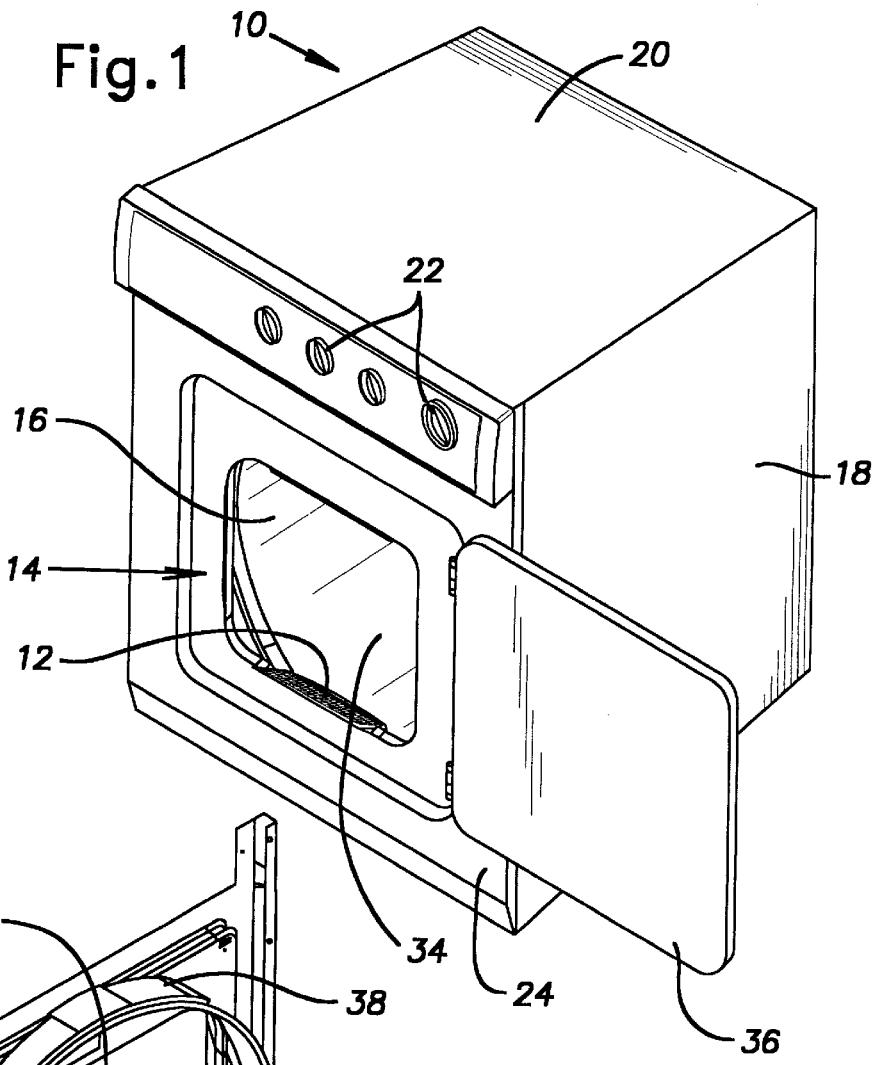
FIG. 1 is a perspective view of a clothes dryer according to the present invention.
Figure 2:
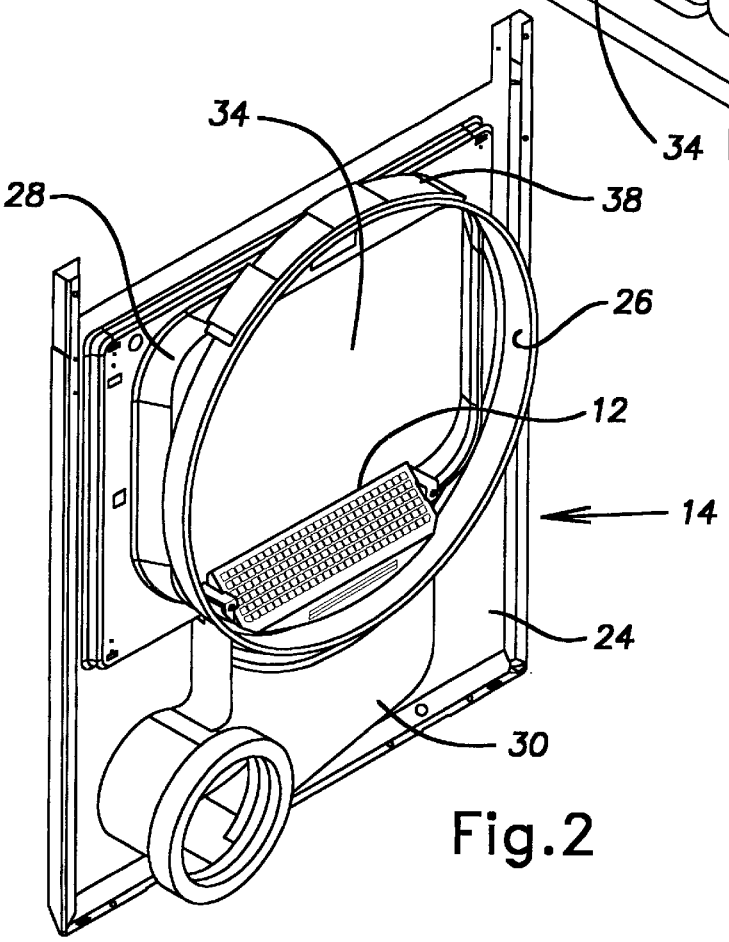
FIG. 2 is a rear perspective view of a front bulkhead assembly according to the present invention.
Figure 3:
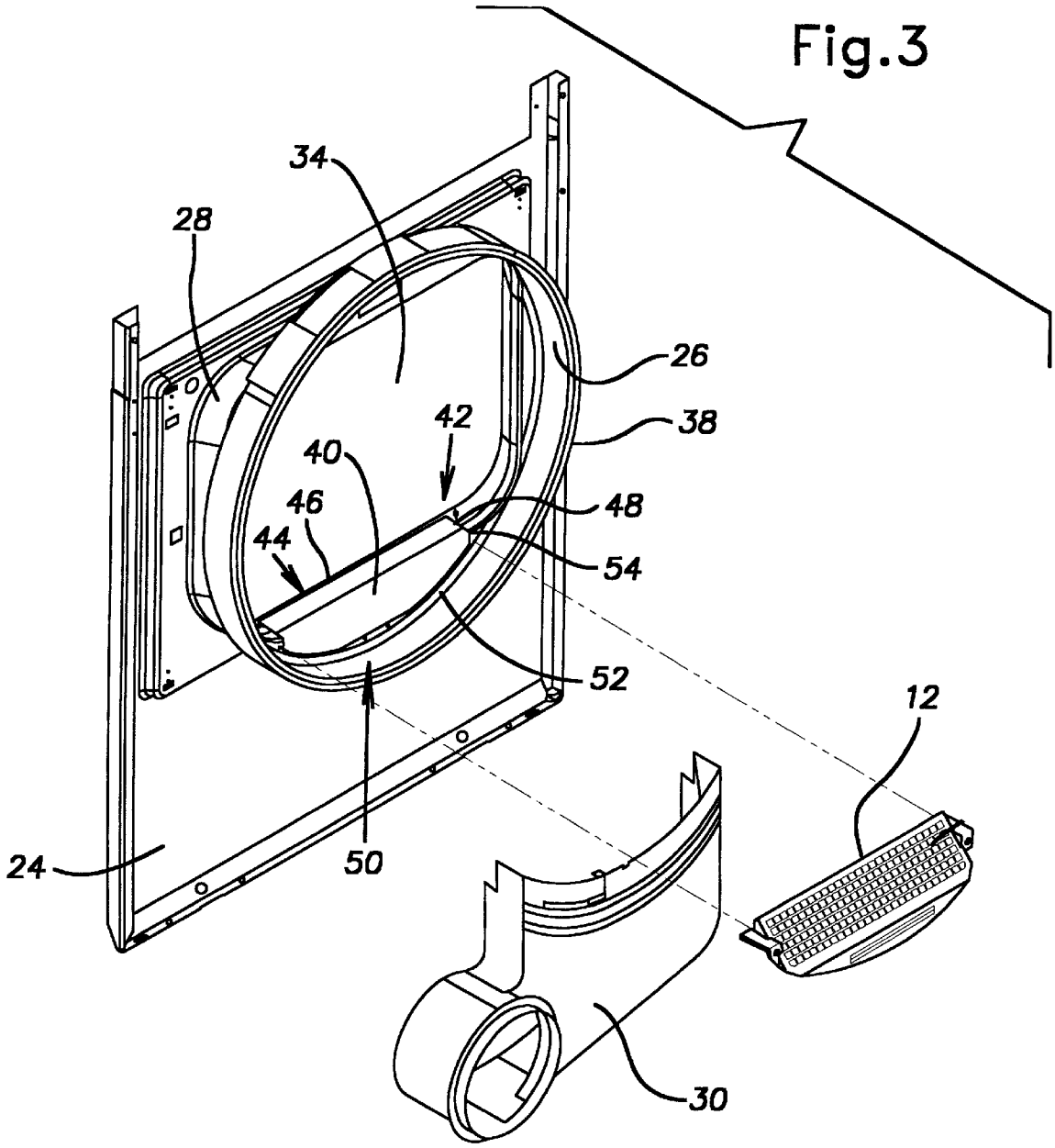
FIG. 3 is a rear exploded perspective view of the front bulkhead assembly shown in FIG. 2.
Figure 4:
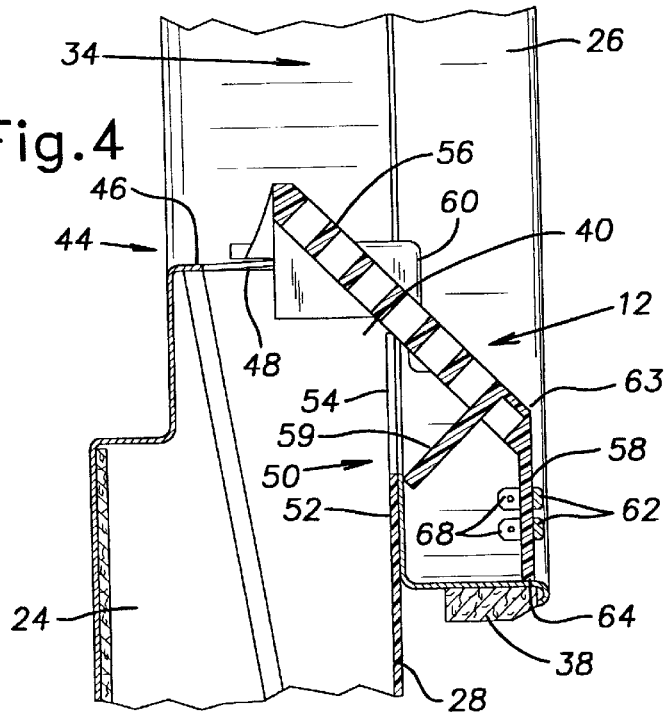
FIG. 4 is a cross-sectional view of the front bulkhead assembly showing the exhaust vent cover therein.
Figure 5:
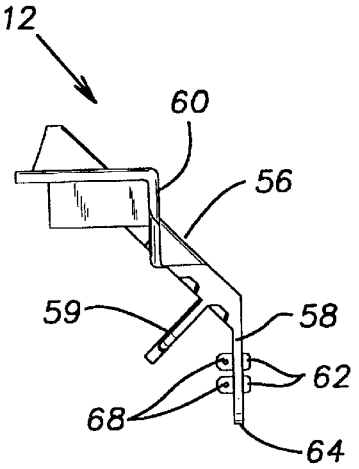
FIG. 5 is an end elevational view of the exhaust vent cover.
Figure 6:
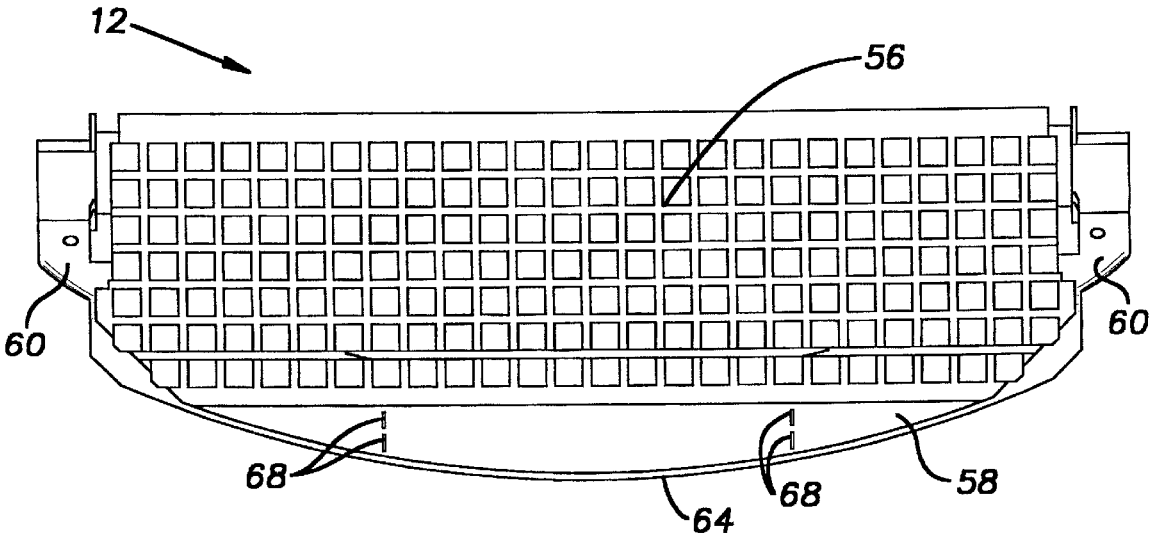
FIG. 6 is a rear elevational view of the exhaust vent cover.
Figure 7:
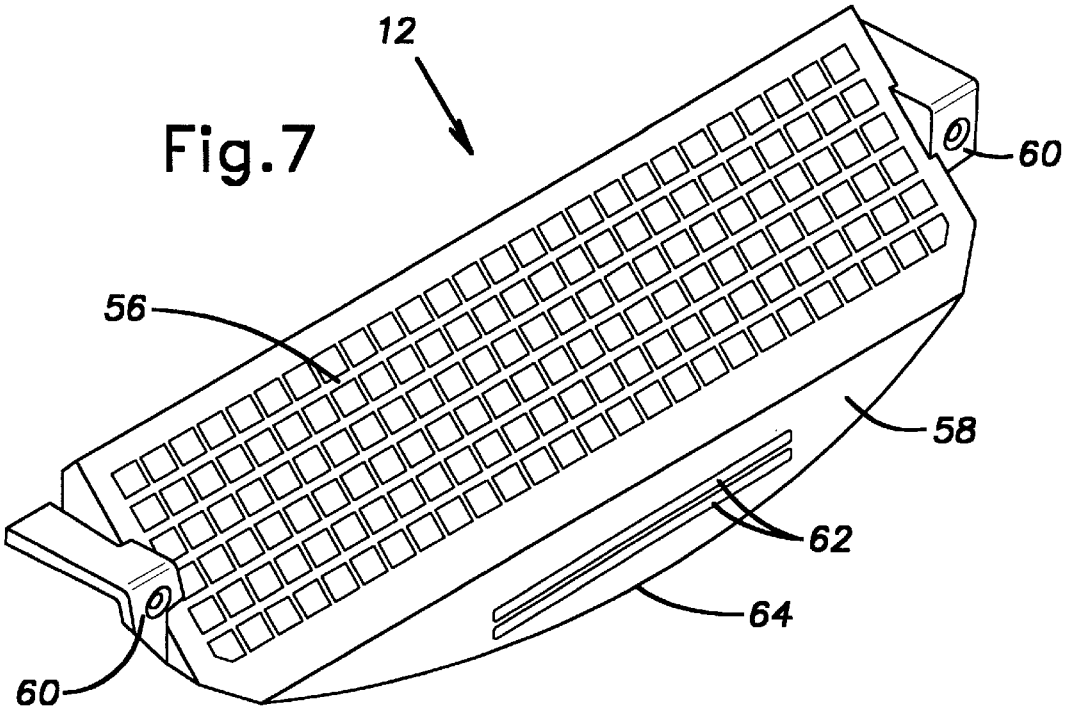
FIG. 7 is a front perspective view of the exhaust vent cover.

With reference to FIGS. 1–3, a clothes dryer 10 incorporating an exhaust vent cover 12 according to the present invention is illustrated. The clothes dryer has a cabinet including a front bulkhead assembly 14 and a rear bulkhead assembly (not shown) which cooperate to rotatably support a dryer drum 16. The cabinet also includes side panels 18 and a top panel 20. In the illustrated and preferred clothes dryer, the dryer control devices 22 are provided at a front of the cabinet. Naturally, the control devices could be disposed at a rear of the cabinet top panel 20, as is more commonplace, without departing from the scope and spirit of the present invention.

As is shown best in FIGS. 2 and 3, the front bulkhead assembly 14 includes a front panel 24, a supporting ring 26, a transition member 28, an exhaust duct 30, and the exhaust vent cover 12. The front panel 24 has an access opening 34 through which the drum interior is accessible. The access opening 34 is closed by a pivotally mounted door 36. The transition member 28 surrounds the access opening 34 and projects rearwardly or inwardly from an interior surface of the front panel 24. A rearward or inner edge of the transition member 28 merges with the supporting ring 26. The supporting ring 26 has a forward end of the dryer drum 16 disposed thereover. Preferably, a seal and bearing assembly 38 is disposed between the supporting ring 26 and the drum 16 to seal the drum interior while reducing friction between the drum 16 and the supporting ring 26 as the drum rotates during use.

A lower portion of the transition member 28 is cut out to define an exhaust air opening 40. A rim 42 surrounds the exhaust air opening. The rim 42 includes an upper portion 44, having front 46 and lateral side members 48 generally disposed in a horizontal plane, and a rearward portion 50, having lower and lateral side members 52, 54 generally disposed in a vertical plane. The exhaust air opening 40 is partially covered by the exhaust vent cover 12. The exhaust duct 30 is secured beneath the exhaust air opening 40 and receives exhaust air from the drum 16. As such, the front bulkhead assembly 14 cooperates with the exhaust vent cover 12 and the exhaust duct 30 to define a receptacle for a blade-type lint filter (not shown). The lint filter is inserted vertically downwardly into the receptacle, and has an enlarged flange or rim that rests upon the surfaces surrounding the exhaust air opening 40. It is believed that various suitable blade-type lint filters are known to those skilled in the art and may be interchangeably used.

As is shown best in FIGS. 3–7, the exhaust vent cover 12 is preferably molded plastic having a first portion 56 and a second portion 58. The first portion 56 is perforated and defines a first plane. The second portion 58 is continuous and defines a second plane. The second plane is at an angle to the first plane, as shown best in FIG. 4. More specifically, the second plane is approximately parallel to the dryer drum access opening 34. The first plane is at an angle of about 45° relative to the second plane. A elongated flange 59 extends away from the cover 12 from generally near the union of the first and second portions 56, 58. The flange 59 limits access to the sensor terminals via the exhaust air opening 40.

The vent cover 12 includes a pair of lateral bosses 60 that align with mounting openings in the rim's rear portion lateral side members 54, and receive fasteners to secure the vent cover 12 to the transition member 28. The second portion 58 of the vent cover has a pair of elongated moisture sensors 62 embedded therein. The sensors 62 are disposed adjacent an arcuate peripheral lower edge 64 of the second portion 58 at a spaced distance from an upper edge 63. The arcuate peripheral edge 64 has a radius matching the radius of the supporting ring 26 such that the vent cover 12 snugly abuts the supporting ring 26 along the lower edge of the vent cover 12.

Figure 8:
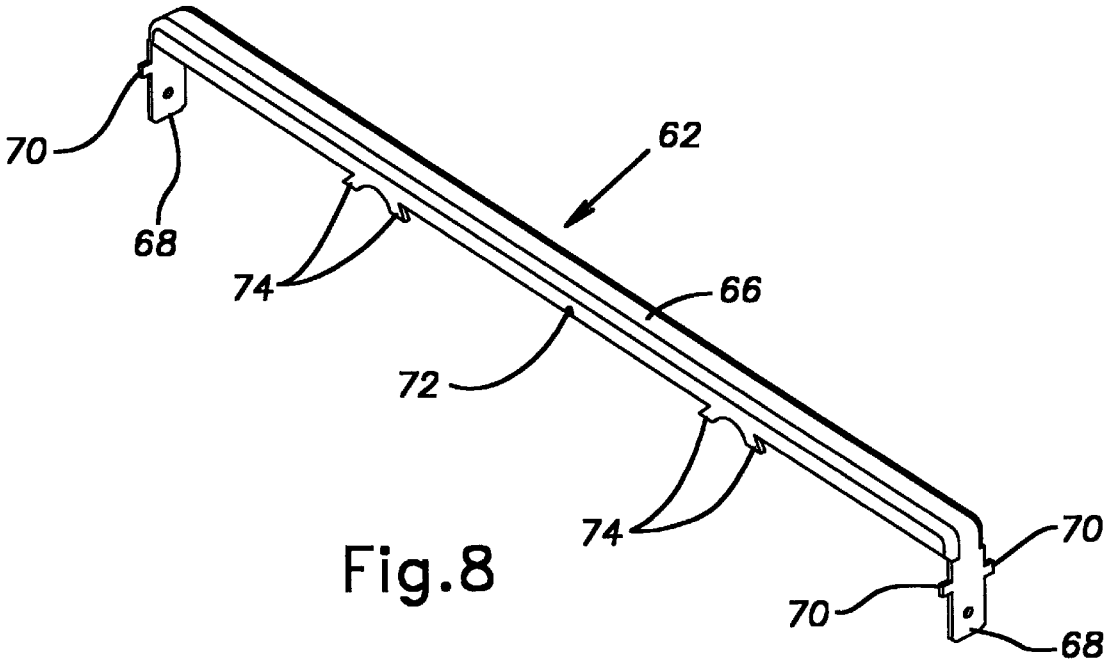
FIG. 8 is a perspective view of a moisture sensor.
Figure 9:
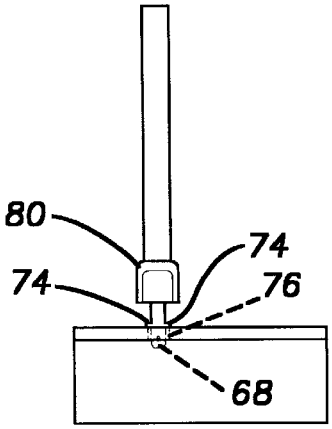
FIGS. 9–13 illustrate heat staking of the moisture sensor to the vent cover.
Figure 10:
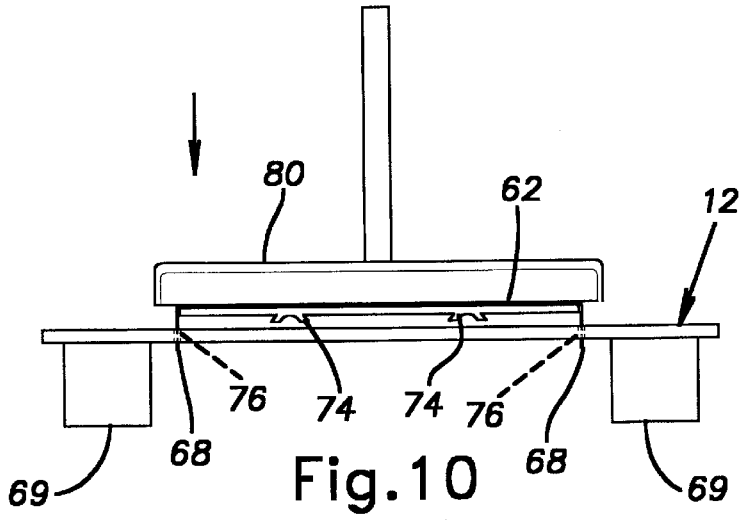

With reference to FIG. 8, the moisture sensors 62 have a body portion 66 with a pair of ends 68. The ends 68 extend perpendicularly away from the body portion 66 and each include a pair of transverse retaining ears 70. The ends 68 serve as terminals to which the sensor is connected to the dryer moisture sensing circuit. The body portion 66 also has a pair of lengthwise-extending flange members 72 that extend away from the body perpendicular to the body portion 66 length direction and generally parallel to the ends 68. Each of the flanges 72 have a plurality of retaining members 74. The retaining members 74 are arcuate-shaped paired projections that serve to help lock the sensor 62 within the exhaust vent cover 12.

With reference to FIGS. 9–13, a preferred method of securely embedding the sensors 62 in the exhaust vent cover 12 is illustrated. Initially, the sensor ends 68 are positioned within pre-formed holes 76 in the plastic vent cover 12 such that the retaining ears 74 abut a rearward face 78 of the second portion 58 adjacent the pre-formed holes 76. The retaining members 74 are spaced from the rearward face 78 of the vent cover 12 a short distance, as shown best in FIG. 10.

The sensor 62 is contacted along the length of its body portion 66 by a heat platen 80. The sensor 62 is heated by the platen 80, causing the subjacent plastic vent cover material to melt and flow. Pressure or force on the sensor body portion 66 via the platen 80 causes the platen 80 to move toward the plastic vent cover 12 and thereby force the sensor ends 68 through the vent cover 12. During this process, the vent cover is supported by a pair of supports 69. The retaining ears 74 are driven through the vent cover 12 and the retaining members 74 and flange members 72 are driven into the rearward face 78 of the vent cover 12.

Figure 11:
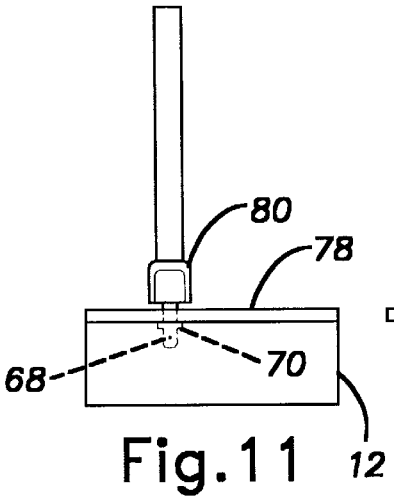
Figure 13:
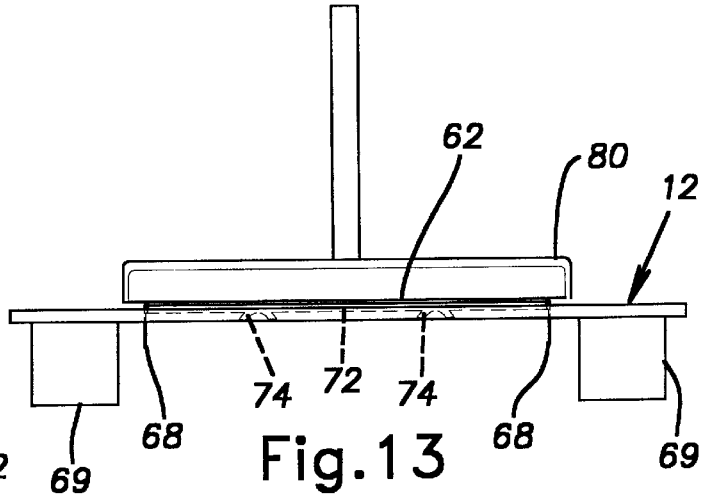
Figure 12:
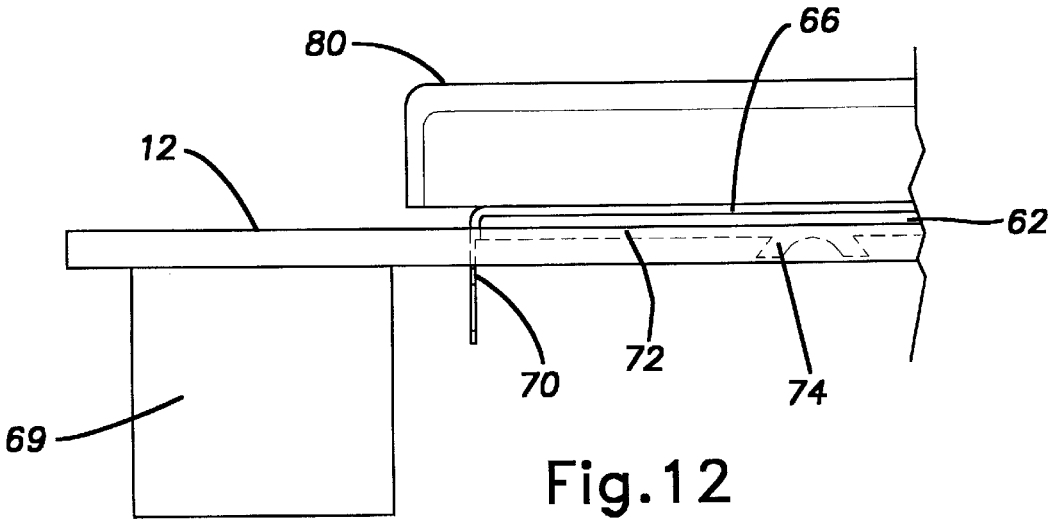

At an end of the staking operation, the sensors 62 and vent cover 12 are generally as shown in FIGS. 11–13. The sensor ends 68 extend through the vent cover 12 such that the transverse retaining ears 70 are adjacent a forward face of the second portion 58 and on an opposite side of the cover 12 relative to the sensor body portion 66. The arcuate-shaped projections or retaining members 74 are completely embedded in the plastic vent cover 12. The lengthwise extending flange members 72 are likewise at least partially embedded in the plastic cover 12. The body 66 of the sensor 62 is disposed slightly above the surface 78 of the cover 12 to facilitate engagement with clothes.

Although the preferred embodiment of the present invention is described herein, it is clear that the present invention is not limited thereto. Rather, the invention is capable of numerous modifications and alterations without departing from the scope and spirit of the invention, as defined in the claims appended hereto.

What is claimed is:

1. A dryer exhaust vent assembly, comprising an exhaust grill having a first portion and a second portion, said first portion defining a first plane and having a series of openings through which air may pass, said second portion comprising a solid panel defining a second plane and having a pair of elongated moisture sensors embedded therein, wherein said first plane is at an angle to said second plane and said sensors are generally remote from said first portion.

2. A dryer exhaust vent assembly according to claim 1, wherein said exhaust grill is formed from a unitary piece of non-conductive material and said sensors are formed from a conductive material.

3. A dryer exhaust vent assembly according to claim 1, wherein said second portion has forwardly and rearwardly directed faces, said sensors projecting from said forwardly directed face and being embedded within said rearwardly directed face.

4. A dryer exhaust vent assembly according to claim 3, wherein said first portion further comprises an elongated tab, said tab being disposed near said forwardly directed face and serving to restrict access to the projecting portion of the sensors.

5. A dryer exhaust vent assembly according to claim 1, wherein said solid panel has an upper edge and a lower edge, said upper edge merging with said first portion, said sensors being disposed relatively closer to said lower edge than said upper edge.

6. A dryer exhaust vent assembly according to claim 5, wherein said second portion has forwardly and rearwardly directed faces, said sensors projecting from said forwardly directed face and being embedded within said rearwardly directed face.

7. A dryer exhaust vent assembly according to claim 6, wherein said first portion further comprises an elongated tab, said tab being disposed near said forwardly directed face and serving to restrict access to the projecting portion of the sensors.

8. A dryer exhaust vent assembly according to claim 7, wherein said exhaust grill is formed from a unitary piece of non-conductive material and said sensors are formed from a conductive material.

9. A clothes dryer, comprising:

a clothes receiving drum having a forward end and a rearward end, said forward end having a circular access opening;

a cabinet including front and rear bulkheads that support the drum for rotation within said cabinet, said front bulkhead including an exhaust opening through which air exits the drum;

an exhaust vent assembly secured to said front bulkhead and partially covering said exhaust opening, said exhaust vent cooperating with said front bulkhead to define a lint filter receptacle, said exhaust vent assembly comprising an exhaust grill having a first portion and a second portion, said first portion defining a first plane and having a series of openings through which air may flow from the drum to the exhaust opening, said second portion comprising a solid panel defining a second plane and a pair of elongated moisture sensors embedded therein, wherein said first plane is at an angle to said second plane, and said second plane is parallel to the drum access opening.

10. A clothes dryer according to claim 9, wherein said second portions have forwardly and rearwardly directed faces, said sensors projecting from said forwardly directed face and being embedded within said rearwardly directed face.

11. A clothes dryer according to claim 10, wherein said first portion further comprises an elongated tab, said tab being disposed near said forwardly directed face and serving to restrict access to the projecting portion of the sensors.

12. A clothes dryer according to claim 9, wherein said solid panel has an upper edge and a lower edge, said upper edge merging with said first portion, said sensors being disposed relatively closer to said lower edge than said upper edge.

13. A clothes dryer according to claim 12, wherein said second portions have forwardly and rearwardly directed faces, said sensors projecting from said forwardly directed face and being embedded within said rearwardly directed face.

14. A clothes dryer according to claim 13, wherein said first portion further comprises an elongated tab, said tab being disposed near said forwardly directed face and serving to restrict access to the projecting portion of the sensors.

15. A clothes dryer according to claim 14, wherein said exhaust grill is a unitary piece formed from a non-conductive material and said sensors are formed from a conductive material.

* * * * *